US007231270B2

(12) United States Patent
Kamdar et al.

(10) Patent No.: US 7,231,270 B2
(45) Date of Patent: Jun. 12, 2007

(54) MOBILE PLAY-LIST METHOD

(75) Inventors: Hitan S. Kamdar, Utica, MI (US); Matthew P. Burton, Ortonville, MI (US); Anthony Luke Simon, West Bloomfield, MI (US)

(73) Assignee: General Motors Corporation, Detroit, MI (US)

( * ) Notice: Subject to any disclaimer, the term of this patent is extended or adjusted under 35 U.S.C. 154(b) by 718 days.

(21) Appl. No.: 10/607,503

(22) Filed: Jun. 26, 2003

(65) Prior Publication Data

US 2005/0009466 A1 Jan. 13, 2005

(51) Int. Cl.
*H04H 9/00* (2006.01)

(52) U.S. Cl. ..... 700/94; 369/7

(58) Field of Classification Search ..... 700/94; 369/7

See application file for complete search history.

(56) References Cited

U.S. PATENT DOCUMENTS 6,915,176 B2 * 7/2005 Novelli et al. ..... 700/94
6,985,782 B1 * 1/2006 Watanabe ..... 700/94
2002/0083454 A1 6/2002 Braxton
2003/0194977 A1 10/2003 Videtich et al.

FOREIGN PATENT DOCUMENTS

JP 11046342 * 2/1999

OTHER PUBLICATIONS

Machine translation of JP11046342 by Japanese Patent Office.*

* cited by examiner

*Primary Examiner*—Daniel Swerdlow
(74) *Attorney, Agent, or Firm*—Anthony Luke Simon

(57) ABSTRACT

A mobile play list method, comprising the steps of: broadcasting a work and identification for the work over a broadcast system; receiving the broadcast work and identification in a mobile device; receiving, from a user, an input identifying the broadcast work as desired by the user; monitoring at the mobile device for a subsequent broadcast of the work; storing the work in the mobile device during the subsequent broadcast, and selectively playing the work in the mobile device in response to a request of the user.

8 Claims, 2 Drawing Sheets

MOBILE PLAY-LIST METHOD

TECHNICAL FIELD

This invention relates to a mobile play-list method.

BACKGROUND OF THE INVENTION

It is known to use networks such as the Internet to sell digital copies of works, such as music. It has also been proposed to link sales of items to listeners of broadcast radio content, allowing the user to select purchases based upon what the user is listening to in the broadcast content.

It is also known to digitally store music in mobile players, such as MP3 players.

SUMMARY OF THE INVENTION

This invention provides a mobile play-list method.

Advantageously, this invention provides an improved method for downloading and storing selected audio items, such as music, to a mobile device for later playing. Advantageously, in a preferred example, this invention provides improvements over prior methods for downloading music by providing an efficient method for creating digital music libraries on mobile devices utilizing existing technology already available on many systems, such as in-vehicle telematics systems.

Advantageously, according to a preferred example, a user of a mobile device can identify songs of choice during broadcast of the song, and the mobile device will monitor for future broadcasts of the song or songs of choice, store those songs in a play list, and make the songs available for selective playback to the user at the request of the user.

Advantageously, according to a preferred example, this invention provides a mobile play list method comprising the steps of: broadcasting a work and identification for a work over a broadcast system, receiving the broadcast in a mobile device, receiving a user input identifying the broadcast work as desired by the user, monitoring at the mobile device for a subsequent broadcast of the work, storing the work in the mobile device during the subsequent broadcast, and selectively playing the work in the mobile device in response to a request by the user.

DESCRIPTION OF THE PREFERRED EMBODIMENT

Figure 1:
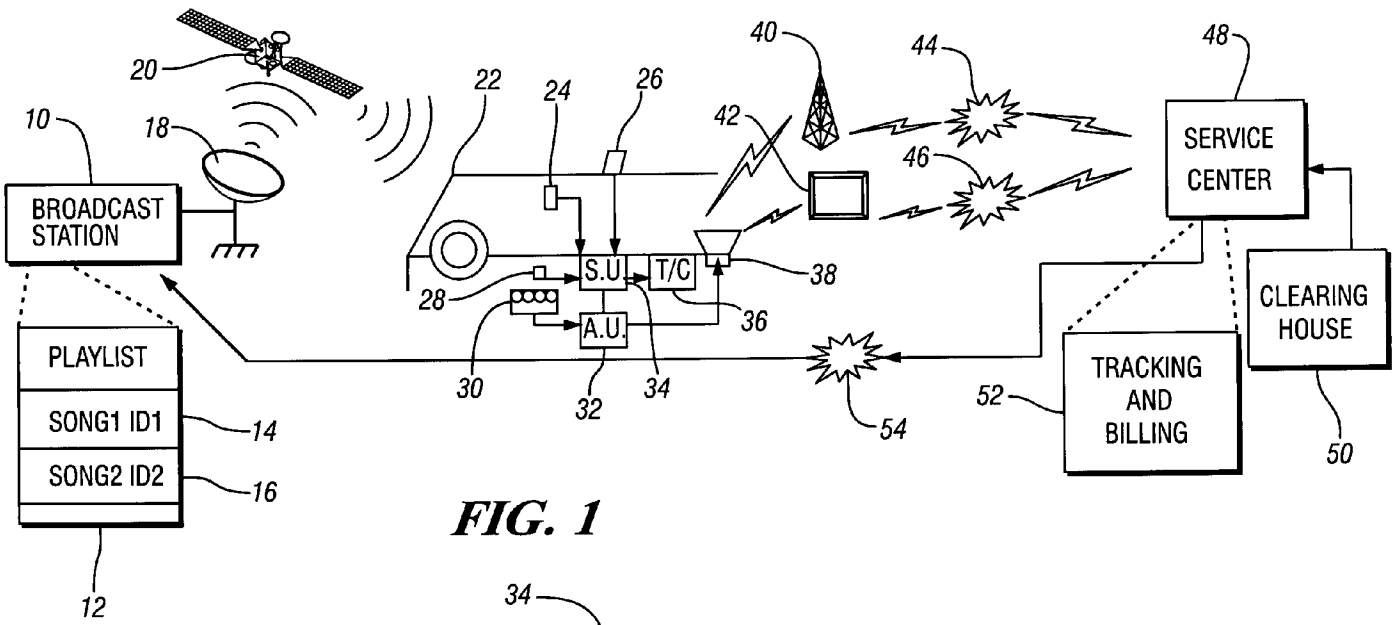
FIG. 1 illustrates a system for implementing an example method of this invention.

Referring now to FIG. 1, a broadcast station 10 performs all of the known steps of broadcasting digital audio programming. In the preferred example, the broadcast station 10 is a satellite radio broadcaster and the broadcast content of the one or more stations made available by the broadcast station 10 are transmitted to a satellite uplink station 18 for uplink to a satellite 20 for broadcast to a series of digital audio receivers. The satellite radio broadcast system may also include a series of terrestrial repeaters (not shown) for supplementing coverage of the satellite broadcast signal.

While satellite radio broadcast is the preferred example, this invention works equally well with any digital audio broadcast.

In a known manner, the broadcast station 10 broadcasts a series of audio works, referred to as the play-list 12, including in this example Song1 14 and Song2 16, each having its digital content, including a digital signal identifying the work being broadcast. The works, such as songs, are broadcast for real-time listening during receipt of the broadcast as is known in the broadcast industry.

Any digital radio device adapted for receiving the broadcast content may be used. This invention is preferably used with mobile devices, such as satellite radio receiver unit 34 (or other digital radio receiver) within vehicle 22. The satellite radio receiver unit 34 receives the broadcast content utilizing satellite signal antenna 26, which provides the received signal to the satellite radio receiver unit 34 in a known manner. The satellite radio receiver unit 34 may either be a separate unit adapted for use with an audio unit, such as the audio unit 32 or may be integrated to perform all of the functions of receiving the satellite radio signal and convention vehicle audio functions, and further may include known telematics functions. For examples including telematics units, GPS or other vehicle locating functions are included as well as any known telematics function). In the example shown in FIG. 1, the satellite radio receiver unit 34 is shown as separate from the conventional vehicle audio unit.

The satellite radio receiver unit 34 processes the digital satellite radio signal broadcast by the broadcast station 10 and transmits that signal to the audio unit 32 for play of the selected station through the vehicle audio system speakers, represented schematically by speaker 38. Stations may be selected by one or more buttons 28 associated with the satellite radio receiver unit 34 or one or more buttons 30 associated with the vehicle's audio unit 32.

An operator input is provided, for example a button 28, or one or more of the buttons 30, to receive an input from a user of the vehicle 22 indicating that the user chooses the song or work currently being broadcast as a desired work. As explained below, the desired work is to be stored in a digital library within the memory of the satellite radio receiver unit 34 or the audio unit 32.

Upon receipt of the user input indicating user choice of the broadcast work, the satellite radio receiver unit 34 stores a signal identifying the work to which the user is currently listening. This signal may be a digital identification signal broadcast with the work, or some other signal that allows the satellite radio receiver unit 34 to recognize a subsequent broadcast of the same work.

This method can be used with works currently under copyright ownership for which license to download is required. In this example, the user input is taken in as a request under a user sale or licensing program for copyrighted works, such as popular music. The type of purchase program, for example, fixed fee per work, variable fee per work, fixed monthly or yearly fee for all works downloaded to the unit, is the choice of the system designer and business conditions arranged with the copyright owner(s) and/or clearing house(s) 50.

The request for purchase is transmitted to a service center 48. The service center 48 may be any facility suitable for tracking purchase requests and billing for downloaded works. In a preferred example, the purchase request is transmitted by a transceiver 36 with the mobile unit to the service center 48. One example for transmitting the request is to use the mobile telephone or radio network represented by tower 40 and cloud 44. Another example for transmitting the request is through a home computer 42 utilizing a short-range wireless transceiver function within transceiver 36. In this example, when the vehicle is away from the home computer (i.e., the user is driving it and it is not near the user's home), the purchase requests are maintained in the satellite radio receiver unit 34 until the vehicle 22 arrives in proximity of the home computer 42 to allow the short-range communication to occur. The home computer 42, then contacts the service center 48 utilizing the Internet 46, a telephone line or other available connection.

The service center 48 logs the request, and in a preferred example, sends a reply to the satellite radio receiver unit 34 acknowledging the request and enabling recording and playing of the work. The acknowledgment signal may help ensure that unauthorized use of the work does not occur. But it is understood that in systems where the acknowledgment signal is utilized, it may occur before or after recording, because either way the system may prevent playback of the work until receipt of the acknowledgment signal.

The service center 48 tabulates requests and transmits them through any suitable connection 54 to the broadcast station 10. Broadcast station 10 may make use of the information of requests to judge the popularity of songs, but more importantly for purposes of this invention, to ensure that songs that are requested are scheduled for subsequent broadcast so that satellite radio receiver unit 34 can complete the download of the work. In this example, a commercial arrangement between the broadcaster and the clearinghouse 50 might include a distribution fee paid to the broadcaster for sale or license of the work to the user.

Once the user request is made, the satellite radio receiver unit 34 monitors the content broadcast from broadcast station 10. This monitoring may be done using a low power consumption mode enabling active monitoring even when the vehicle 22 is not in use, but so as not to drain the vehicle battery. For examples in which this invention is implemented in a satellite digital radio system, the satellite radio receiver unit 34 may monitor all stations broadcast, and when the subsequent broadcast of the work is made, the satellite radio receiver unit 34 records the digital content of the work, and adds it to the user's play list. While this example assumes the play list function is within satellite radio receiver unit 34, it is understood that this function (including storage of the works in memory and selective playback thereof), may be done in the vehicle audio unit 32, or a combined unit that performs the satellite radio receiver function, the audio unit functions, and in some examples, telematics functions.

The storage of the work during subsequent broadcast may be accomplished by assembly the digital content as broadcast through the satellite radio system. The assembly reverses the effects of multiplexing or interleaving techniques, which causes the work to be segregated into data packets for broadcast. These data packets may then be aggregated at the satellite radio receiver unit 34. It may also be desirable for the satellite radio receiver unit 34 to reformat the data before storage, but such choices are left to the system designer.

The works stored in the satellite radio receiver unit 34 (or the audio unit 32, or if implemented, a combined unit (not shown)) are available for selective playback at the request of the user. Any known form of input/output function may be utilized for selective playback, including buttons 28, 30, which include associated display(s) (not shown). Alternatively, a voice user interface may be implemented in which the microphone 24 acts as input for voice commands, that are recognized and utilized to navigate through a menu provided by audio playback through the speakers 38 or through a visual display.

Figure 2:
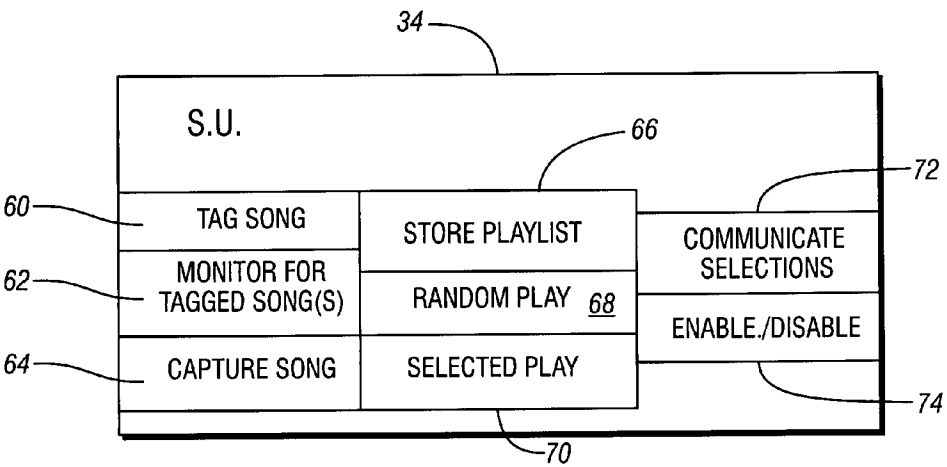
FIG. 2 illustrates sample functions embodied in mobile hardware according to an example of this invention.

Referring now also to FIG. 2, the example schematic satellite radio receiver unit 34 shown includes example functions for implementing this invention. Block 60 represents the function allowing the user to tag a song or work during listening, for example, by pressing a button. This tagging stores an identification code indicating that the song or work tagged is desired for recording into storage during a subsequent broadcast. Block 62 represents the function of monitoring for the tagged song(s) and block 64 represents the function of capturing the song into storage during subsequent broadcast.

Block 66 represents the function of storing a play-list of captured songs and blocks 68 and 70 represent two known song playback functions—random playback during which stored works are played in a pseudorandom order as determined by the unit 34 and selected play during which stored works are played as selected by the user.

Block 72 represents the communication function described above. Block 74 represents the enable/disable function 74 that may be implemented to coordinate purchase of license rights or subscription service to the ability to capture and store songs in the satellite radio receiver unit 34.

Figure 3:
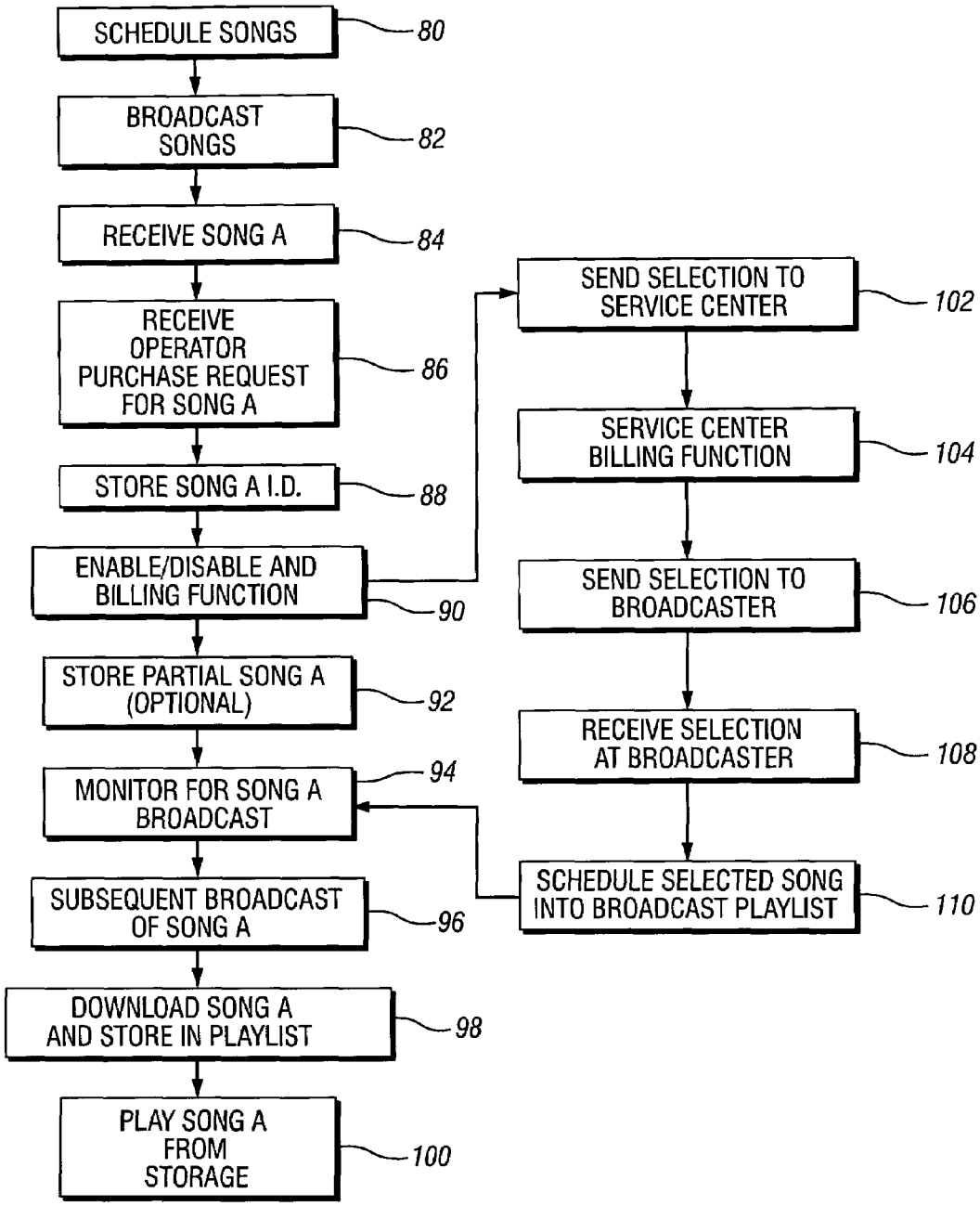
FIG. 3 illustrates an example set of method steps according to this invention.

Referring now to FIG. 3, the example method steps listed may be implemented in the system shown in FIG. 1. Block 80 represents the scheduling of songs to be broadcast at a broadcast station 10. Block 82 represents the broadcasting of songs or works. In the satellite radio example, the broadcast includes the transmission to the satellite uplink station 18. In the non-satellite radio example, the broadcast includes the transmission through conventional radio antennas. For nationally broadcast programs through non-satellite systems, the broadcast may start from a national station, transmit to various local stations through any suitable method, including satellite network, and then be rebroadcast by the local stations for reception by units 34 within range of the local station.

An individual unit 34 receives a broadcast work (block 84) and the operator of the unit provides an input (block 86) indicating a desire to store the work for future playback. Block 88 represents the function of storing data identifying the work as desired for recording during a subsequent broadcast.

Block 90 represents an enable and disable and billing function for coordinating license rights of works with the ability of a user to record broadcast songs. The function 90 can be implemented any number of ways, including through monthly billing and individual billing per song download.

The billing function 90 includes communication with a service center 102 that performs account management functions 104, such as charging to a credit card a license fee for purchase of the song, and/or checking for active subscription by the user. A communication may be sent back to the unit through any available network (e.g., mobile phone network, or the satellite radio network) enabling or disabling the storage function so that the unit can record the song during subsequent playback.

Service center 48 can send the identifications of works selected by users to the broadcast station 10 at blocks 106 and 108 to facilitate scheduling of rebroadcast of the work (block 110) and to provide feedback on works purchased.

As an optional function, the satellite radio receiver unit 34 can begin storage of a song immediately upon receipt of the request (block 92). In this case, only a portion of the work might be stored immediately and the rest may be stored during subsequent broadcast.

Blocks 94, 96 and 98 represent the functions of monitoring for subsequent broadcast of the song, subsequently broadcasting the song, and storing the song in memory during the subsequent broadcast. And block 100 represents the subsequent play back of the song(s) or work(s) in the play list in the manner directed by the user.

The invention claimed is:

1. A mobile play list method, comprising the steps of:

broadcasting a work and identification for the work over a broadcast system;

receiving the broadcast work and identification in a mobile device;

receiving, from a user, an input identifying the broadcast work as desired by the user;

monitoring at the mobile device for a subsequent broadcast of the work;

storing the work in the mobile device during the subsequent broadcast, and selectively playing the work in the mobile device in response to a request by the user.

2. The mobile play list method according to claim 1, further comprising sending a request identifying the broadcast work desired by the user from the mobile device to a remote receiver.

3. The mobile play list method according to claim 2, wherein the remote receiver is a call center.

4. The mobile play list method according to claim 1, wherein the broadcast system comprises a satellite radio broadcast system.

5. A mobile play list method comprising the steps of:

scheduling a set of songs for broadcast;

broadcasting the scheduled songs for receipt by mobile devices and real-time listening by at least one user of one of the mobile devices;

broadcasting a digital signal identifying each broadcast song;

receiving, during real-time listening by the at least one user and at the one of the mobile devices, a user request for purchase of the broadcast song being broadcast during the listening;

in response to the user request and the digital signal, storing in a memory of the one of the mobile devices a request for the broadcast song;

monitoring at the one of the mobile devices for a subsequent broadcast of the requested song;

storing digital content of the requested song during the subsequent broadcast of the requested song; and selectively playing from memory of the one of the mobile devices, the stored song.

6. The mobile play list method according to claim 5, further comprising sending a request identifying the broadcast song from the one of the mobile devices to a remote receiver.

7. The mobile play list method according to claim 6, wherein the remote receiver is a call center.

8. The mobile play list method according to claim 3, wherein broadcasting the scheduled songs comprises broadcasting the songs via a satellite radio system, and wherein broadcasting a digital signal identifying each broadcast song comprises broadcasting the digital signal via a satellite radio broadcast system.

* * * * *